US006583590B1

(12) United States Patent
Chu

(10) Patent No.: US 6,583,590 B1
(45) Date of Patent: Jun. 24, 2003

(54) STRING DRAWING DEVICE FOR A RACQUET

(76) Inventor: David Chu, No. 160, Chung-Cheng Rd., Taichung (TW)

( * ) Notice: Subject to any disclaimer, the term of this patent is extended or adjusted under 35 U.S.C. 154(b) by 0 days.

(21) Appl. No.: 10/058,692

(22) Filed: Jan. 28, 2002

(30) Foreign Application Priority Data

Aug. 10, 2001 (TW) ..... 90213634 U

(51) Int. Cl.[7] ..... H02P 7/74

(52) U.S. Cl. ..... 318/34; 318/5; 318/7; 318/8; 318/19; 318/280; 318/283; 473/553; 473/555; 473/556; 473/557

(58) Field of Search ..... 318/5, 7, 8, 19, 318/34, 280, 283; 473/553, 555, 556, 557; 273/73 A

(56) References Cited

U.S. PATENT DOCUMENTS 3,628,109 A * 12/1971 Plummer ..... 318/11
3,635,080 A * 1/1972 Krueger et al. ..... 73/145
3,668,485 A * 6/1972 Norris ..... 318/102
3,718,289 A * 2/1973 Alaimo ..... 242/190
3,918,713 A * 11/1975 Kaminstein ..... 273/73
4,375,180 A * 3/1983 Scholz ..... 84/454
4,376,535 A * 3/1983 Muselet et al. ..... 273/73
4,620,705 A * 11/1986 Tsuchida ..... 273/73 A
4,813,821 A * 3/1989 Hirota ..... 408/9
5,733,212 A * 3/1998 Wise et al. ..... 473/557
6,162,139 A * 12/2000 Bassili ..... 473/557

* cited by examiner

*Primary Examiner*—Bentsu Ro
*Assistant Examiner*—Tyrone Smith
(74) *Attorney, Agent, or Firm*—William E. Pelton, Esq.

(57) ABSTRACT

A string drawing electrical device for a racquet has a casing, a string holder, an actuating device and a control unit. The string holder is rotatably attached to a panel of the casing. The actuating device is mounted in the casing and provides two functions, feeding and reversing, to the string holder. The control unit is mounted in the casing for controlling the actuating device to act. Accordingly, the string drawing electrical device can tighten and loosen the string, and the tensile force of the string of the racquet can be accurately controlled.

8 Claims, 5 Drawing Sheets

STRING DRAWING DEVICE FOR A RACQUET

BACKGROUND OF THE INVENTION

1. Field of the Invention

The present invention relates to a string drawing device, and more particularly to a string drawing device for tightening the string of a racquet.

2. Description of Related Art

To play tennis, squash or badminton, a racquet is necessary piece of equipment. The racquet substantially comprises a frame and a string woven on the frame. The ball or the shuttlecock is struck back to the opponent with the racquet, and the speed of the struck back ball is determined by the tightness of the string, as well as other factors. Therefore, the tightness of the string is a very important factor for a racquet. To tighten the string, a string drawing device is always used. However, the traditional string drawing is a manual device. To tighten the string is dependent on the experience of the user of the string drawing device and variations in users and even their particular moods causes uneven tensions in different sections of the string.

With reference to FIG. 5, a conventional electrical string drawing device is provided to solve the problems arisen from the traditional manual string drawing device. The conventional electrical string drawing device in accordance with the prior art comprises a casing (70) and an actuator (not shown). The actuator is mounted in the casing (70), and the actuator is a motor rotating in a single direction. The shaft of the motor extends out from the casing (70), and a string holder (72) is attached to the exposed end of the shaft. Accordingly, the string can be held on the holder (72) and be tightened by means of the rotation of the motor.

Although the conventional string drawing electrical device can electrically tighten the string of a racquet, the string will be tightened too much if the motor keeps rotating. When the tightness of the string is much more than the predetermined degree, the user must loosen the over-tight string manually and cannot use the conventional string drawing device because of the single rotating direction of the motor. To loosen the over-tight string is very troublesome, and the use of the conventional string drawing is not versatile.

To overcome the shortcomings, the present invention tends to provide a string drawing device to mitigate or obviate the aforementioned problems.

SUMMARY OF THE INVENTION

The main objective of the present invention is to provide a string drawing electrical device that can tighten and loosen the string of a racquet. The string drawing device has a casing, a string holder, an actuating device and a control unit. The string holder is rotatably attached to a panel of the casing. The actuating device is mounted in the casing and provides two functions, feeding and reversing, to the string holder. The control unit is mounted in the casing for controlling the actuating device to operate. Accordingly, the string holder can be actuated to rotate in two opposite directions so as to tighten or loosen the string. The tensile force of the string of the racquet can be accurately controlled, and the use of the string drawing device is versatile.

Further benefits and advantages of the present invention will become apparent after a careful reading of the detailed description with appropriate reference to the accompanying drawings.

DETAILED DESCRIPTION OF THE INVENTION

Figure 1:
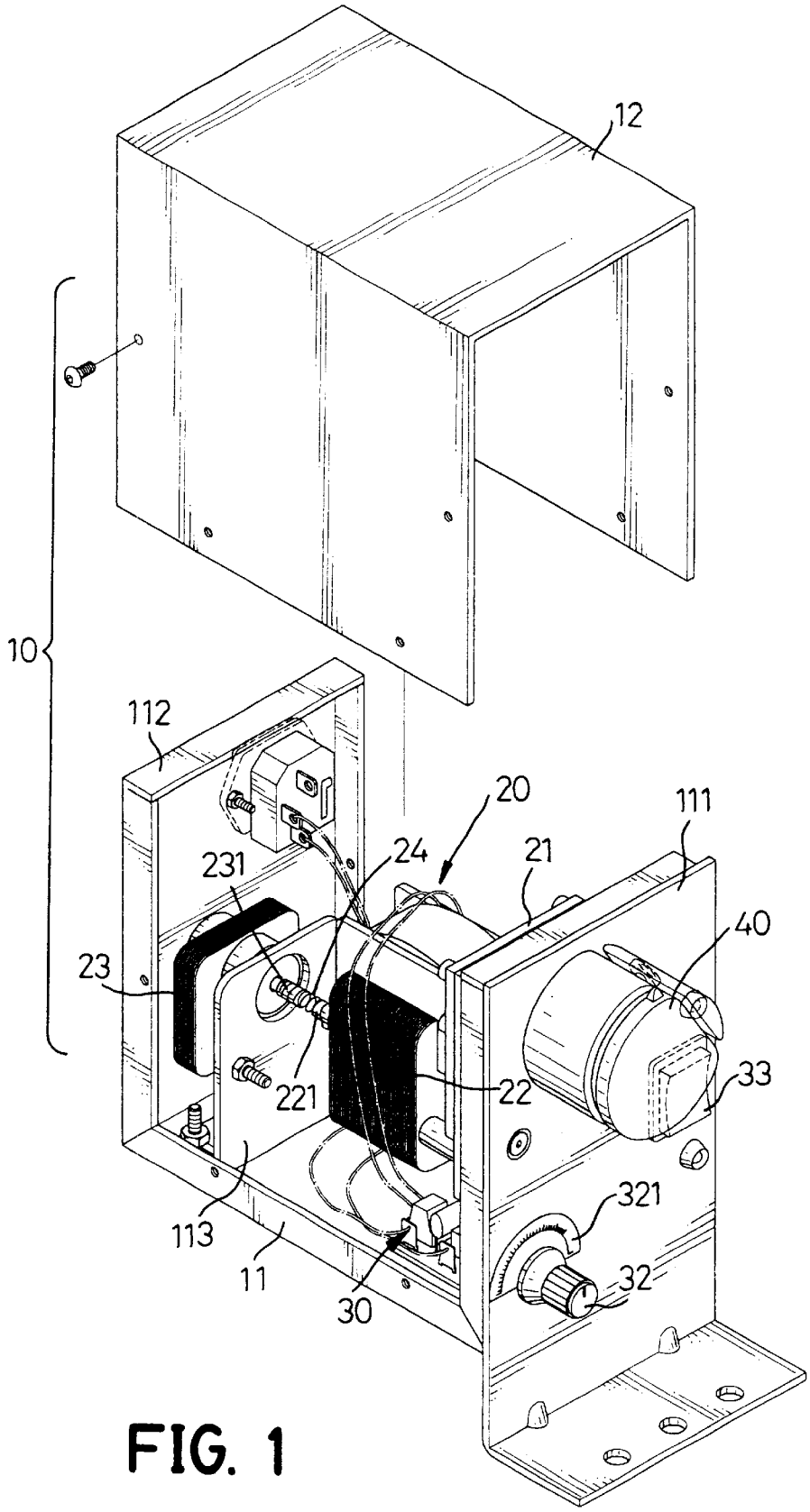
FIG. 1 is a partially exploded perspective view of a string drawing device for a racquet in accordance with the present invention.
Figure 2:
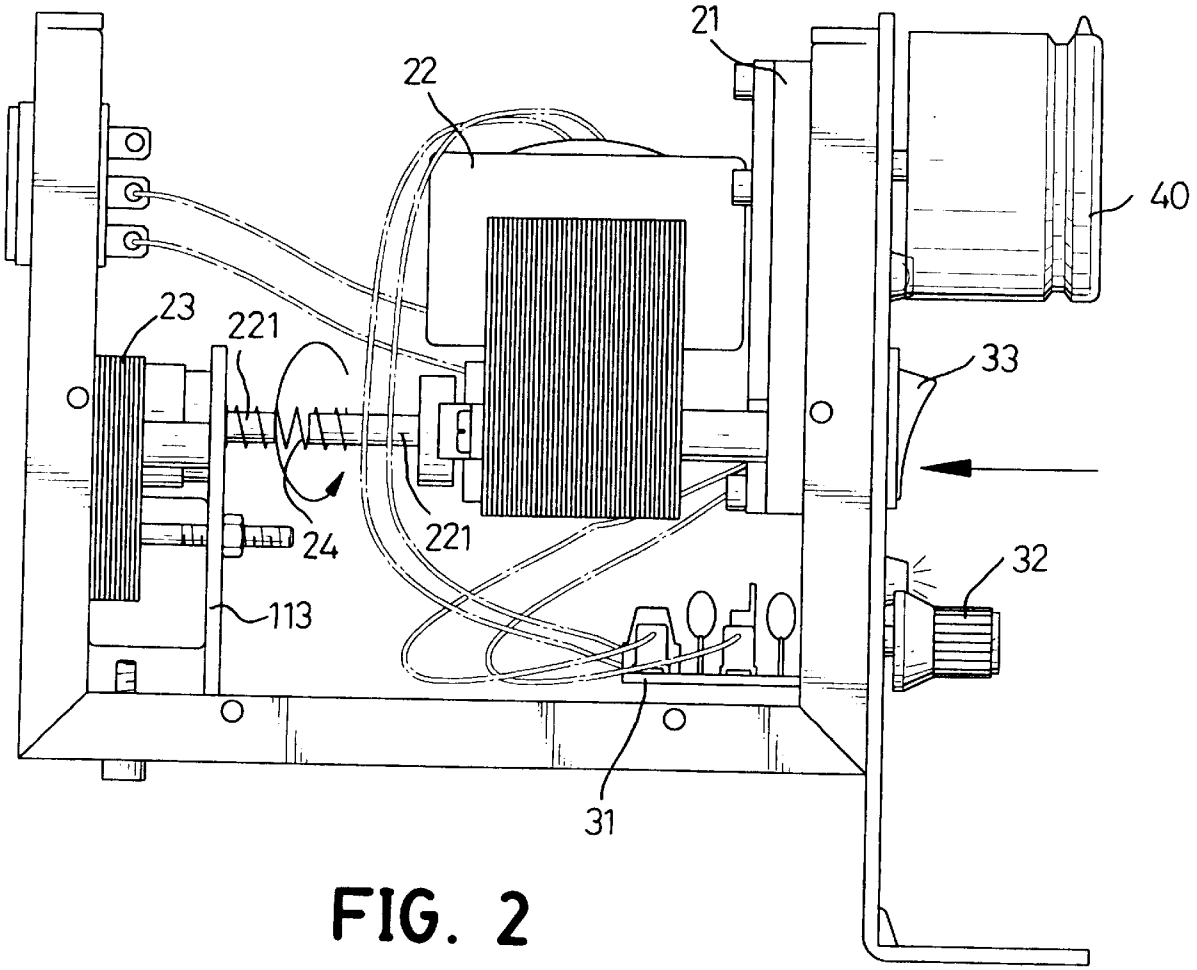
FIG. 2 is an operational side plan view of the string drawing device in FIG. 1 showing that the string holder is actuated to rotate in a certain direction.

With reference to the drawings and initially to FIGS. 1 and 2, a string drawing device for a racquet in accordance with the present invention comprises a casing (10), a string holder (40), an actuating device (20) and a control unit (30). The casing (10) comprises a U-shaped base (11) and an n-shaped cover (12) engaging with the base (11) to define a closed receiving space in the casing (10). The U-shaped base (11) includes a first vertical portion set as a panel (111) and a second vertical portion set as a back plate (112). A supporting plate (113) is perpendicularly attached to the bottom of the base (11) near the back plate (112).

The string holder (40) is rotatably attached to the panel (111) of the base (11). The string holder (40) is driven by the actuating device (20) to rotate relative to the casing (10) and is adapted for securely clamping a string of the racquet.

The actuating device (20) is mounted in the casing (10) to rotate the string holder (40) relative to the casing (10). The actuating device (20) comprises a feeding motor (22) and a reversing motor (23). The feeding motor (22) is mounted in the casing (10) and has a shaft (221) with a first end connected to the string holder (40). In practice, a reduction device (21) is mounted on the inner side of the panel (111). The reduction device (21) is connected to the first end of the shaft (221) of the feeding motor (22) to reduce the rotating speed of the feeding motor (22). The reduction device (21) has a main shaft (not shown) extending through the panel (111) and securely connected with the string holder (40). Consequently, the string holder (40) can rotate at a very low speed with the transmission of the reduction device (21).

The reversing motor (23) is secured on the supporting plate (113) and is situated between the supporting plate (113) and the back plate (112) of the base (11). The reversing motor (23) has a shaft (231) extending to align with a second end of the shaft (221) of the feeding motor (22).

The two shafts (221, 231) respectively of the feeding motor (22) and the reversing motor (23) are connected to each other with a connector (24). In the preferred embodiment of the present invention, the connector (24) is flexible and is a spring. Consequently, the reduction device (21) is driven whether the feeding motor (22) or the reversing motor (23) is operated.

The control unit (30) is used to control the action of the actuating device (20). The control unit (30) has a printed circuit board (31) mounted on the inner side of the panel (111). The printed circuit board (31) is electrically connected to the feeding motor (22) and the reversing motor (23) for controlling the working time of the feeding motor (22) and the reversing motor (23) to draw or release the string of the racquet.

An adjusting member (not shown) is attached to the printed circuit board (31) and electrically connected to the feeding motor (22) and the reversing motor (23). The adjustment member has a pivot axle (not shown) extending through the panel (111). An adjustment knob (32) is attached to the exposed end of the pivot axle to operate the adjusting member. Accordingly, a user can adjusting the operating times of the feeding motor (22) and the reversing motor (23) with the adjustment knob (32) and the adjusting member so as to adjust the desired tension applied to the string. A dial (321) is mounted on the outer side of the panel (111) and corresponds to the adjustment knob (32). The dial (321) is electrically connected to the print circuit board (31) to show the tension applied to the string. With the adjustment knob (32) and the dial (321), the user can accurately control the tensile force applied to the string of the racquet.

A switch (33) with two operating steps is mounted in the panel (111) and electrically connected to the printed circuit board (31). The two steps of the switch (33) respectively control the feeding motor (22) and the reversing motor (23) to act. When a user presses the upper portion of the switch (33), the feeding motor (22) is switched on to work continually without need for further physical contact from the user of the string drawing device. Then the string holder (40) is driven to rotate and to draw the string clamped on the holder (40). When the tensile force of the string reaches the requirement set by the user with the function of the control unit (30), the feeding motor (22) will be stopped.

Figure 3:
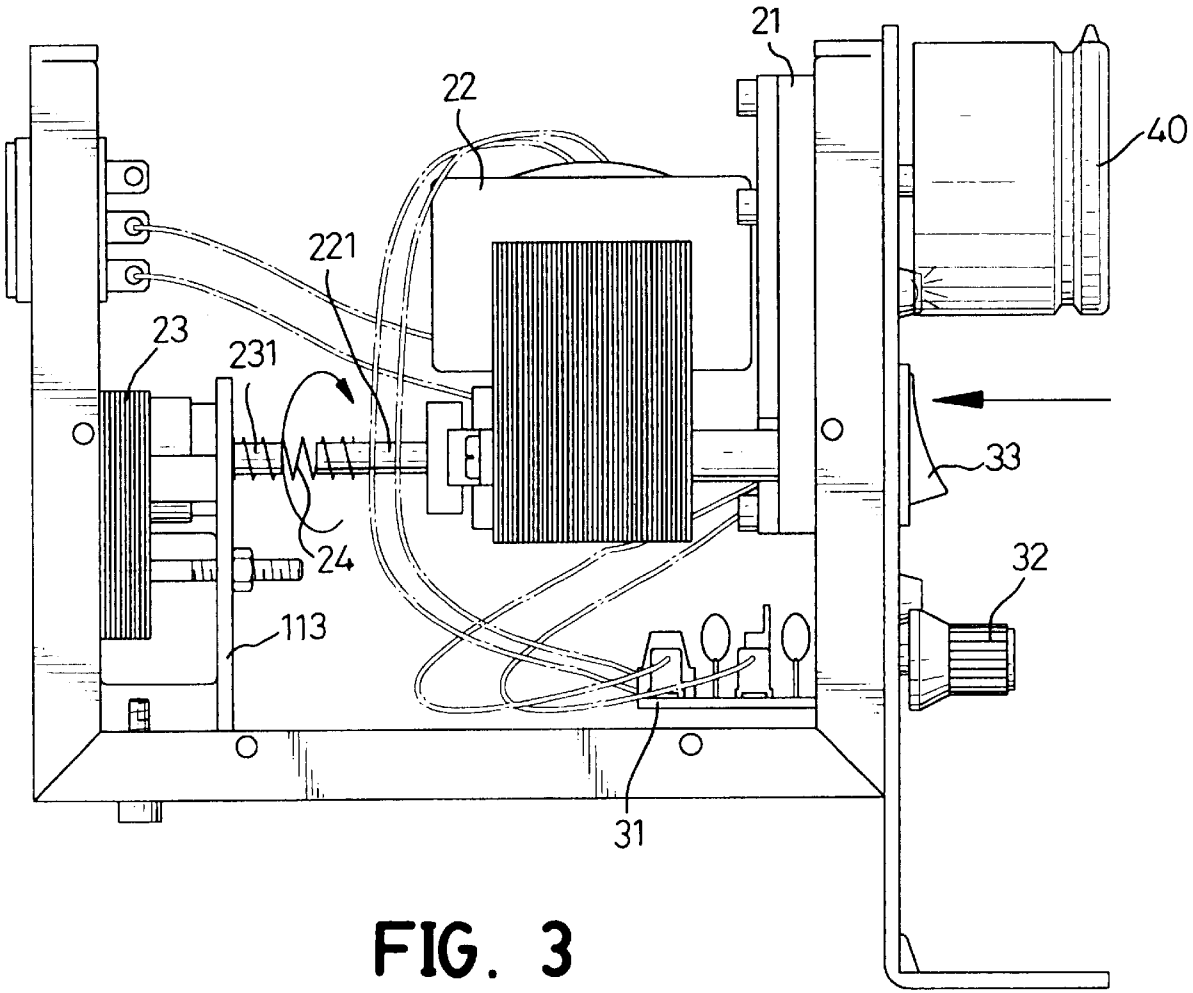
FIG. 3 is an operational side plan view of the string drawing device in FIG. 1 showing that the string holder is actuated to rotate in another direction.

With reference to FIG. 3, when the lower portion of the switch (33) is pressed, the reversing motor (23) is actuated to rotate the shaft (221) of the feeding motor (22) and the string holder (40) in an opposite direction with the transmission of the flexible connector (24). The opposite rotation of the string holder (40) can loosen the string in a slow speed. The switch (33) returns to the original position and the reversing motor (23) is stopped when the user ceases to push the lower portion of the switch (33). Consequently, if the tightness of the string is over the desired degree, the user can loosen the over-tight string directly and automatically by means of pushing the lower portion of the switch (33), whereby to adjust the tension of the string is very convenient. In addition, when the string on the racquet is replaced with a new one, the opposite rotation of the string holder (40) also can release the string from the frame of the racquet at a very slow speed. This can prevent the frame of the racquet from deforming when the tensile force of the string is released too fast.

Figure 4:
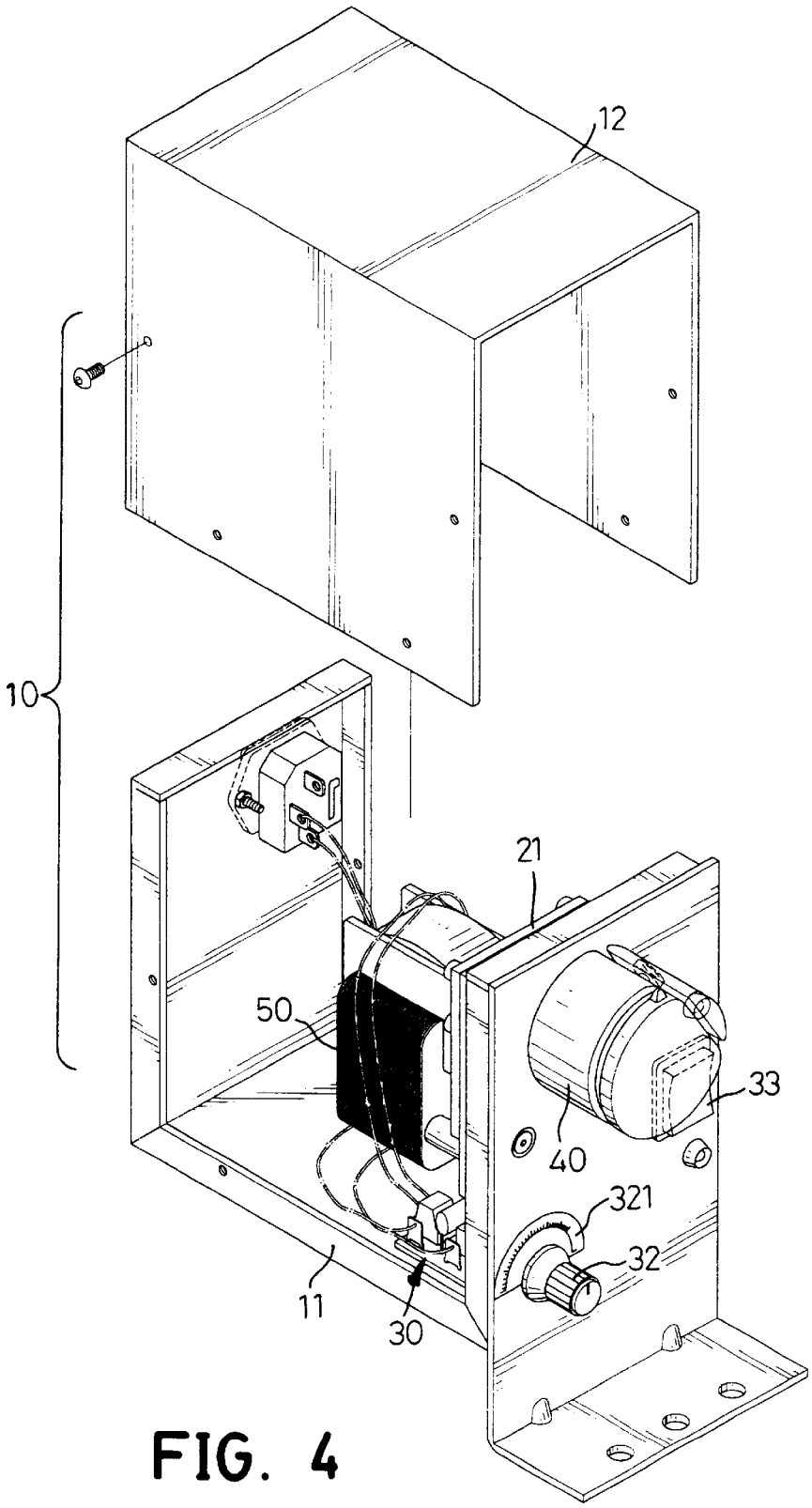
FIG. 4 is a partially exploded perspective view of another embodiment of a string drawing device for a racquet in accordance with the present invention.
Figure 5:
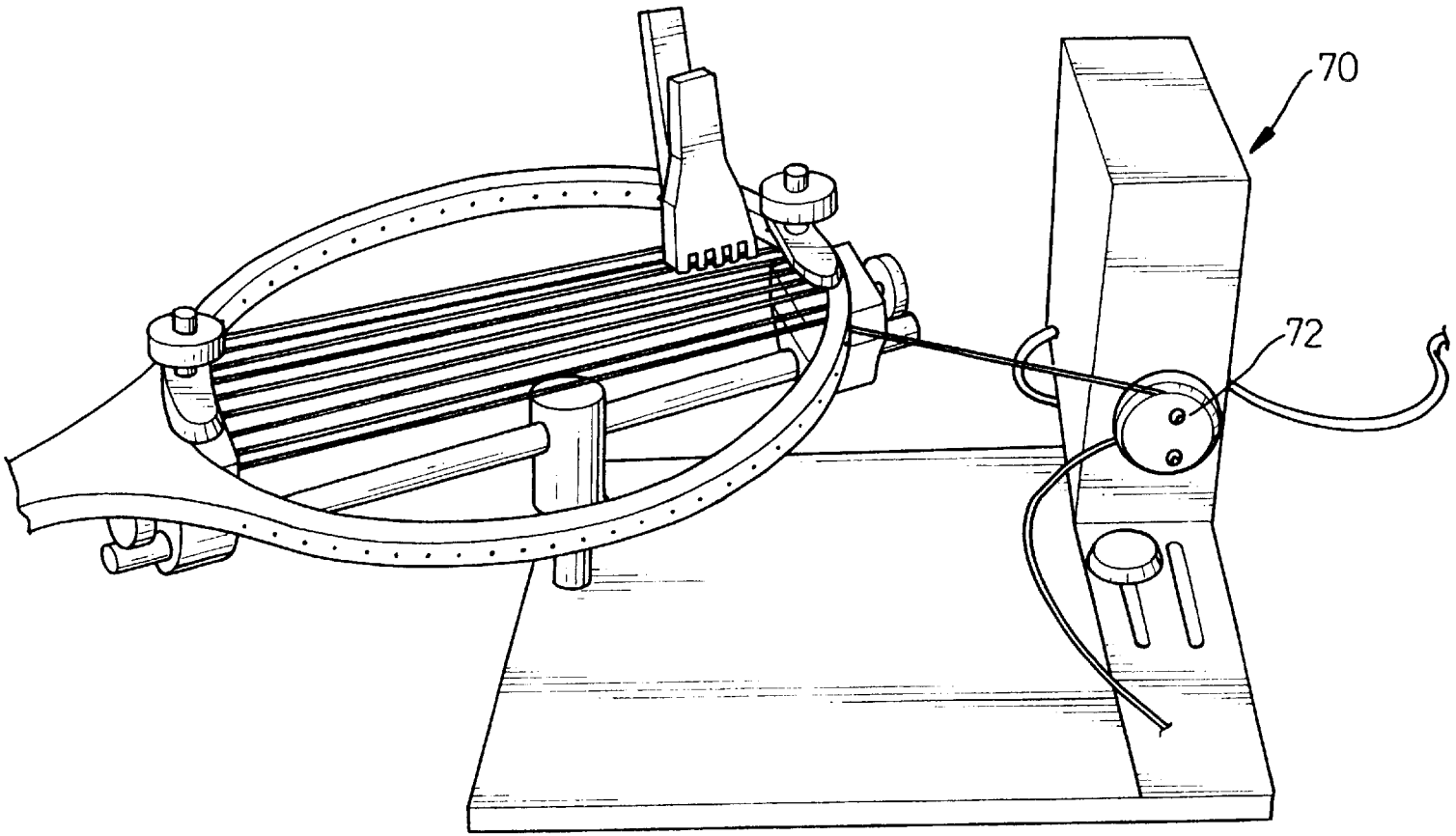
FIG. 5 PRIOR ART
FIG. 5 is an operational perspective view of a conventional string drawing device for a racquet in accordance with the prior art.

With reference to FIG. 4, another embodiment of the drawing device for a racquet in accordance with the present invention is shown. The feeding motor (22) and the reversing motor (23) as shown in FIG. 1 are replaced by a reversible motor (50), however the operating method is the same as the first embodiment of the present invention. The supporting plate (113) of the base (11) and the reversing motor (23) are not necessary with the reversible motor (50) whereby the manufacturing cost is lower than that of the first embodiment.

As described above, the drawing device for a racquet in accordance with the present invention has several advantages as follow.

1. The tensile force of the string of the racquet is accurately controlled. The output torsion force of the feeding motor (22) and the reversing motor (23) are pre-set so that the tensile force of the string of racquet is uniform and the quality of the racquet is controlled well.

2. Because the actuating device (20) can simultaneously provide the feeding and the reversing functions, to weave the string on the frame and to release the string from the frame can be achieved with the same apparatus, and thus the use of the string drawing device is versatile.

Although the invention has been explained in relation to its preferred embodiments, it is to be understood that many other possible modifications and variations can be made without departing from the spirit and scope of the invention as hereinafter claimed.

What is claimed is:

1. A string drawing device for a racquet comprising:

a casing including a panel formed on one side of the casing;

a string holder rotatably attached to the panel of the casing and adapted to hold a string of the racquet an actuating device mounted in the casing to rotate the string holder and providing two functions of feeding and reversing to the string holder, the actuating device comprising:

a feeding motor mounted in the casing and rotating in a first direction, the feeding motor having a shaft extending through the feeding motor, and the shaft having a first end connected to the string holder and a second end;

a reversing motor mounted in the casing and rotating in a second direction opposite to the first direction of the feeding motor, the reversing motor having a shaft corresponding to the second end of the shaft of the feeding motor; and a flexible connector with two opposite ends respectively secured on the second end of the shaft of the feeding motor and the shaft of the reversing motor;

a reduction device mounted in the casing and connected to the first end of the shaft of the feeding motor, the reduction device having a main shaft extending through the panel and connected with the string holder; and a control unit mounted in the casing for controlling actions of the actuating device.

2. The string drawing device as claimed in claim 1, wherein the control unit comprises:

a printed circuit board attached to an inner side of the panel and electrically connected to the feeding motor and the reversing motor; and a switch mounted in the panel and electrically connected to the printed circuit board, the switch having two operating steps for operating the feeding motor and the reversing motor respectively.

3. The string drawing device as claimed in claim 2, wherein the control unit further comprises an adjusting member attached to the printed circuit board to control operating times of the feeding motor and the reversing motor;

the adjusting member has a pivot axle extending through the panel of the casing; and an adjustment knob is attached to the pivot axle to operate the adjusting member.

4. The string drawing device as claimed in claim 3, wherein the control unit further comprises a dial attached to an outer side of the panel, corresponding to the adjustment knob and electrically connected to the printed circuit board to be adapted to show the tensions applied to the string.

5. The string drawing device as claimed in claim 1, wherein the flexible connector is a spring.

6. The string drawing device as claimed in claim 1, wherein the casing is composed of a U-shaped base and an n-shaped cover engaging with the U-shaped base to define a closed receiving space in the casing to receive the actuating device and the control unit.

7. The string drawing device as claimed in claim 6, wherein the panel is vertically formed on one end of the U-shaped base; and a back plate is vertically formed on the other end of the U-shaped base.

8. The string drawing device as claimed in claim 6, wherein the casing comprises a supporting plate perpendicularly extending upwardly from a bottom of the U-shaped base for the reversing motor being attached to the supporting plate.

* * * * *